US008054183B2

(12) United States Patent
Villiger

(10) Patent No.: US 8,054,183 B2
(45) Date of Patent: Nov. 8, 2011

(54) PROCESS AND OVERALL SYSTEM FOR THE SECURE TRANSPORTATION OF VALUABLE OBJECTS

(76) Inventor: Peter Villiger, Beinwil (CH)

( * ) Notice: Subject to any disclaimer, the term of this patent is extended or adjusted under 35 U.S.C. 154(b) by 449 days.

(21) Appl. No.: 11/886,051

(22) PCT Filed: Mar. 6, 2006

(86) PCT No.: PCT/EP2006/060486

§ 371 (c)(1),
(2), (4) Date: Apr. 25, 2008

(87) PCT Pub. No.: WO2006/094962

PCT Pub. Date: Sep. 14, 2006

(65) Prior Publication Data

US 2008/0278322 A1 Nov. 13, 2008

(30) Foreign Application Priority Data

Mar. 7, 2005 (CH) ..... 385/05

(51) Int. Cl.

| | |
|---|---|
| ***G08B 13/14*** | (2006.01) |
| *G08B 1/08* | (2006.01) |
| *G08B 29/00* | (2006.01) |
| *E05G 1/00* | (2006.01) |

(52) U.S. Cl. ..... 340/568.1; 340/571; 340/539.26; 340/539.21; 340/539.23; 340/5.73; 340/5.28; 109/25; 109/45

(58) Field of Classification Search ..... 340/568.1, 340/5.73; 109/25
See application file for complete search history.

(56) References Cited

U.S. PATENT DOCUMENTS

| | | | | |
|---|---|---|---|---|
| 4,155,079 | A * | 5/1979 | Chiu et al. | 340/571 |
| 4,722,435 | A * | 2/1988 | Mareels et al. | 206/1.5 |
| 4,799,435 | A * | 1/1989 | Boutroy | 109/25 |
| 5,615,625 | A * | 4/1997 | Cassidy et al. | 109/45 |
| 5,850,966 | A * | 12/1998 | Siler et al. | 232/15 |

(Continued)

FOREIGN PATENT DOCUMENTS

EP 0 692 599 A1 1/1996

(Continued)

OTHER PUBLICATIONS

International Search Report for International Application No. PCT/EP2006/060486.

*Primary Examiner* — George Bugg
*Assistant Examiner* — Jack Wang
(74) *Attorney, Agent, or Firm* — McCarter & English, LLP

(57) ABSTRACT

Method and system for safely transporting valuable articles to a client. A known amount of articles for transport are packed in a transport package comprising a security circuit and a security system for the valuable articles. In the armed state the valuable articles are devaluated in case of an unauthorized manipulation in the transport package. A first client identifier is given. The valuable articles in the transport package are transported to the client. A portable computer transported with the valuable articles serves for recording and/or capturing the first client identifier, for capturing a second client identifier, for evaluating the first client identifier and the second client identifier, and for establishing a communication connection with the security circuit of the transport package, in order to transfer and release the package into the not-armed state, if permitted after evaluating the client identifiers.

22 Claims, 3 Drawing Sheets

U.S. PATENT DOCUMENTS

| | | | | |
|---|---|---|---|---|
| 5,963,131 | A * | 10/1999 | D'Angelo et al. | 340/568.1 |
| 6,065,408 | A * | 5/2000 | Tillim et al. | 109/25 |
| 6,553,922 | B1 * | 4/2003 | Lundblad et al. | 109/25 |
| 7,707,950 | B2 * | 5/2010 | Villiger | 109/24 |
| 2003/0011466 | A1 * | 1/2003 | Samuel et al. | 340/5.73 |
| 2004/0090773 | A1 * | 5/2004 | Bryan | 362/156 |
| 2004/0100379 | A1 * | 5/2004 | Boman et al. | 340/539.26 |
| 2005/0001719 | A1 * | 1/2005 | Aupperle et al. | 340/539.13 |
| 2005/0077347 | A1 * | 4/2005 | Uematsu et al. | 235/379 |
| 2005/0099292 | A1 * | 5/2005 | Sajkowsky | 340/539.13 |
| 2006/0208852 | A1 * | 9/2006 | Wenzlik et al. | 340/5.28 |
| 2007/0008118 | A1 * | 1/2007 | Kassiedass | 340/539.21 |

FOREIGN PATENT DOCUMENTS

| | | | |
|---|---|---|---|
| EP | 1 069 540 | A2 | 1/2001 |
| EP | 1 271 424 | A1 | 6/2003 |

* cited by examiner

PROCESS AND OVERALL SYSTEM FOR THE SECURE TRANSPORTATION OF VALUABLE OBJECTS

CROSS-REFERENCE TO RELATED APPLICATIONS

This application is the U.S. National Stage of International Application No. PCT/EP2006/060486, filed Mar. 6, 2006, which claims priority to Swiss Patent Application No. CH 00385/05, filed Mar. 7, 2005, both of which are expressly incorporated by reference as part of the present disclosure.

BACKGROUND

The invention concerns a method for the safe transport of valuable articles according to the preamble of claim 1 and a overall system for the safe transport of valuable articles according to the preamble of claim 17.

There are numerous different approaches in order to transport valuable articles from one place to another. Also today frequently armoured systems and armed guards are still used.

There are however for some time also so-called intelligent approaches, which reduce the expenditure and the associated costs substantially. Some examples are to be inferred in the following from applicant's patent applications mentioned:

Title: "Sicherheitskoffer, Sicherheitssystem und Sicherheitskomplex" (V060001P-CH), Anmeldedatum 17.9.2004, Gesuchsnummer: 01532/04

Title: "Multifunktionales, tragbares Sicherheitssystem" (V060002P-CH), application date 1 Oct. 2004, application number: CH 01608/04

Title: "Einbau-Kit zum Ausstatten eines Koffers als multifunktionales, tragbares Sicherheitssystem und mit einem solchen Einbau-Kit ausgestattete Koffer" (V060003P-CH), application date 14 Feb. 2005, application number: CH 00243/05

It is common to these intelligent approaches that they make a substantial contribution by means of technical and electronic means for security, without operating in the conventional sense with armouring and such things.

If in the present context valuable articles are mentioned, then it concerns for example the following valuable articles: coins and note money, securities, other valuable articles such as precious metals and jewels, documents or if necessary also poison materials, rare materials or, for example radiating materials which or materials to be shielded, form instance radiating materials.

The demands, which are made in connection with the transport of protection-needy articles, are subject to constant changes. In addition different regulations apply in each country and in co-operation with different insurance companies, and each client, who lets valuable articles transport, has perceptions concerning the logistic operational sequence.

There are, as already mentioned, different valuable articles that have ton be transported. Depending upon kind of the valuable articles the transport containers must have different sizes. In addition most different safety regulations can apply. In practice for this reason alone a large number of most diverse transport containers are in the use.

Transportation companies, which specialized in the transport of valuable articles, must hold therefore a whole multiplicity of different transport containers and also the appropriate vehicles.

Frequently nowadays protective systems are used with the transport and the storage of valuable articles, which serve to protect the holder or owner of the valuable articles against an abuse of the valuable articles if these got lost due to a theft. This happens, by automatically neutralizing respectively devaluating the valuable articles in such a case. The appropriate protective systems are however expensive and complex.

SUMMARY

It is thus an objective of the present invention

- to provide a method of the kind initially mentioned for the safe transport of valuable articles which is flexible, guarantees a high security and which is nonetheless easy to control,
- to provide a overall system of the kind initially mentioned which is flexible, guarantees a high security and which is nonetheless easy to control, whereas the system preferably can be expanded by additional components.

The solution of this objective is achieved

- for the method by the characterizing features of claim 1,
- for the overall system by the characterizing features of claim 17.

Preferred embodiments of the method and the system are defined by the respective dependent claims.

Further features and characteristics of the present invention are explained in greater detail in the following on the basis of exemplary embodiments and with reference to the drawing.

DETAILED DESCRIPTION

Basically identical and/or identically acting constructive elements are provided with identical reference signs in the figures, even if they partially differ from one another. The drawings are strongly simplified and schematized, and the individual components are not drawn to scale.

The expression cash-center is in the present context used as synonym for a place or facility which makes available valuable articles, e.g. money, for transport. The cash-center can for instance be connected to or be part of a bank or a bank-like institution.

The expression client is in the present context used as synonym for a place or facility which receives valuable articles. It does not necessarily concern a person. The reception can also run fully or partly automated. A cash-point dispenser (ATM) or the like can also be understood as a client in the broadest sense.

Figure 1A:
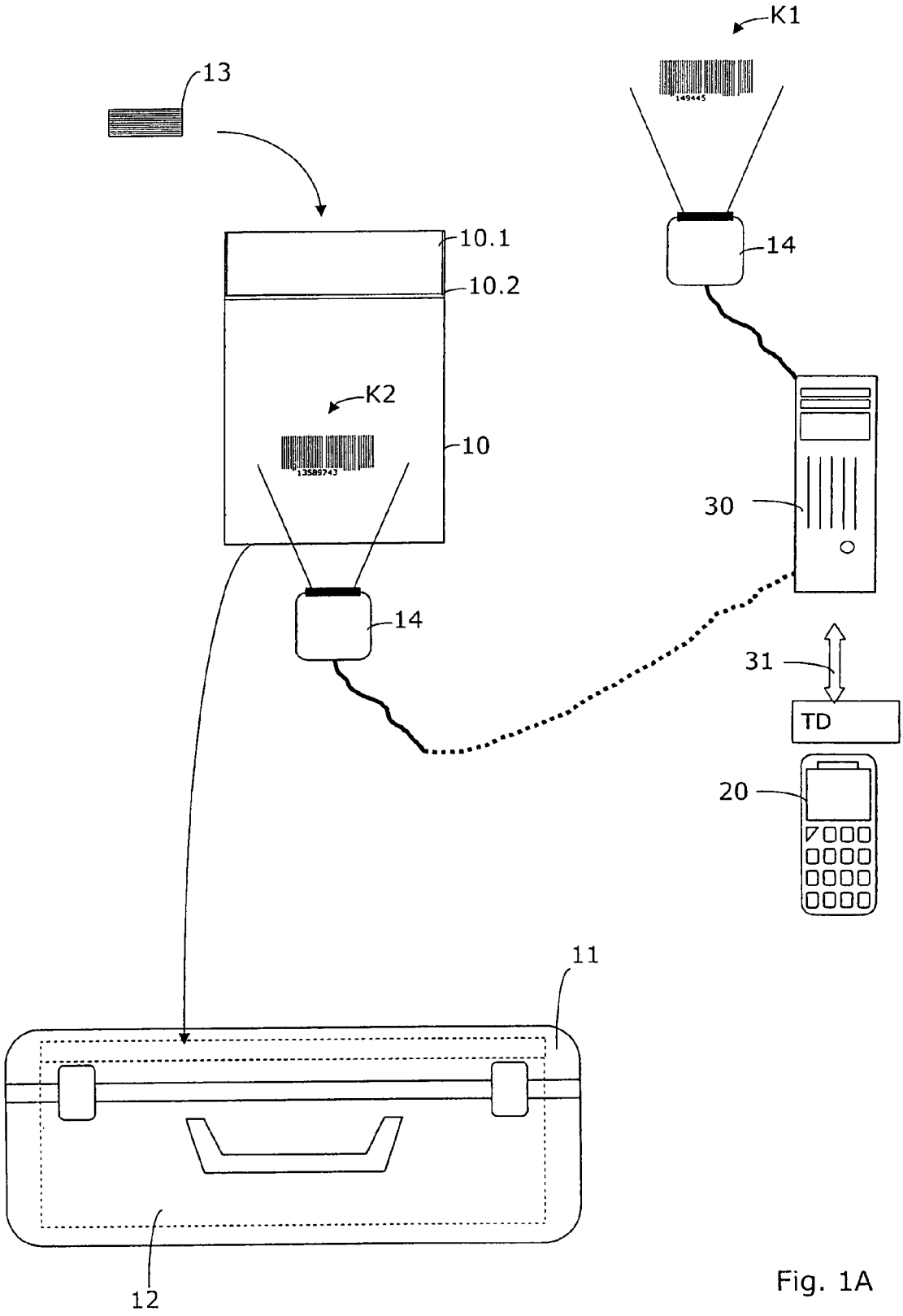
FIG. 1A shows the package of valuable articles according to a first method in accordance with the invention, FIG. 1B the transport and release of valuable articles according to a first method in accordance with the invention, FIG. 2 a listing with several client identifiers K3, which can be employed in a method in accordance with the invention.
Figure 1B:
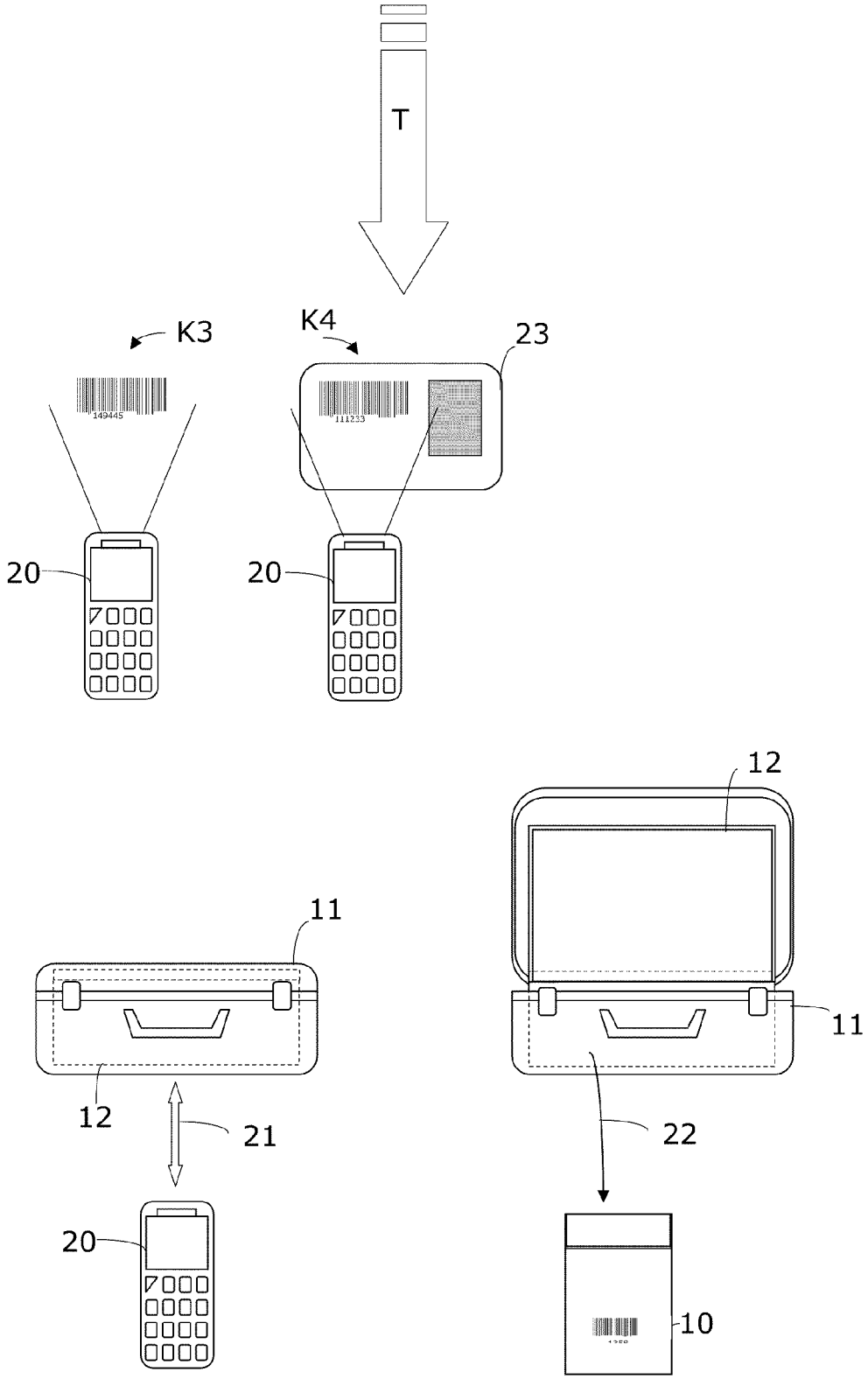

The FIGS. 1A and 1B show a strongly schematic operational sequence of a first method according to the invention, represented in connection with a first overall system with several components. This method is a preferred method using a computer 30, it is however pointed out that the invention can be realized in principle also without this computer 30. In this case part or all tasks are carried out by the portable computer 20.

It concerns, as initially described, a method for safe transporting of valuable articles. In FIG. 1A the valuable articles 13 are represented in the form of bank notes, which form a bundle. These valuable articles 13 are to be transported in a transportation package to a client. The transportation package can cover a combination of an interior package and an external package or only an external package.

In a first step the valuable articles 13, i.e. the notes are packaged. This happens typically in the cash-center or at a comparable place.

In the example of the FIG. 1A the valuable articles and/or notes 13 are put into an interior package 10.

This interior packing 10 can be, as suggested in FIG. 1A, be bag or bag-like casing, preferably a safety bag and/or a so-called sealing bag. The safety bag and/or sealing bag can be liquid permeable. A sealing bag exhibits a catch arrangement. The catch arrangement can be formed by upper flap 10.1 and an adhesive strip 10.2, onto which the upper flap 10.1 is glued. With suitable choice of the material of the sealing bag it can be also locked, whereby its filling opening is in a way welded under increased pressure and/or increased temperature. The interior package 10 and in particular its catch arrangement are designed in such a way that when opening visible traces remain. The interior package 10 can be also a cartridge or a box, preferably from a plastic.

As mentioned further above, one can also do without the interior package 10.

When packing a client identifier, called first client identifier in the following, has to be specified. This first client identifier K1 identifies the client, who is to be supplied 13 with the valuable articles to be transported. The first client identifier K1 can be provided to the computer 30 by entering or reading in, or the first client identifier K1 if necessary is generated. In FIG. 1A an embodiment is shown, where the first client identifier K1 is available as bar code. This first client identifier K1 is scanned by a sensor unit like a read unit 14 and read in into the computer 30.

Then a packing identification K2 is recorded by means of the computer 30. In the present embodiment in accordance with FIG. 1A, where an interior package 10 is used, this packing identification K2 is assigned for example to the interior package 10. If the interior package 10 is dispensed with, then the packing identification K2 is assigned to of the external package.

Also the packing identification K2 can be a bar code, as represented, which is scanned with the read unit 14 and read in into the computer 30.

In a preferred embodiment the computer 30 is designed so that the identifiers K1 and K2 can be generated. For this purpose the computer 30 can be connected to a bar-code printer to print the bar-code, or the computer 30 can comprise a transmitter which facilitates an RF-ID tag to be programmed with an identification.

The interior package 10 and the valuable articles 13 received inside are now put into the exterior package 11, for instance into a special case also denoted by 11. In the embodiment shown the special case 11 comprises a security area 12, which is schematically indicated in FIG. 1A. Details of such a special case can be deferred from the initially mentioned patent application CH00243/05.

Details of this special case 11 are herein explained only as far as this is necessary for an understanding of the invention. The special case 11 comprises a built-in security circuit and a security mechanism. Security circuit and security mechanism together form an intelligent protection system for protecting the valuable articles 13 against unauthorized removal and/or manipulation. In case of a non-authorized manipulation at the safety case 11, the valuable articles 11 comprised inside are neutralized, respectively brought into a state where they have no more value for unauthorized persons. This happens in that a material capable of flowing, for instance an ink from an ink module, is dispensed which dyes the valuable articles contained in a permeable sealing bag. The ink module is a part of the protection mechanism of the case 11.

If a cassette or can is employed as interior package 10 which is not permeable for liquids, the cassette or can may be provided with a protection mechanism including an ink module like the mentioned security case 11.

As protective measure fort he valuable articles ignition means can be present instead if or in addition to the described ink module, which are triggered in case of a not-admitted manipulation of the security case 11 in order to melt the interior package 10 and to neutralize or devaluate the valuable articles 13 due to this. This protective measure is suitable in particular if the interior package 19 is not barely fluid permeable.

In general, different kinds of casks are suited as exterior package as long as they have a protective system with integrated intelligence in combination with a protection mechanism, being suited to protect the valuable articles 13. A further example of such an exterior package can be deferred from the initially mentioned patent application CH 01608/04.

In this special embodiment, the compute 30 now generates transport data, preferably with the aid of suitable cash-center software, which is designated with TD in FIG. 1A. These transport data TD are transmitted from the computer 30 to a further, portable computer 20. This is indicated in FIG. 1A by a double-headed arrow 31. The transmission of the transport data TD preferably is carried out wireless, for example by means of infrared (IR) or radio frequency (RF) transmission.

For instance a PDA, a notebook computer or another intelligent communications system can serve as portable computer 20. It is also conceivable to employ a specially equipped mobile phone. As mentioned, the portable computer 20 can also replace the computer 30.

Now the actual transport of the valuable articles 13, which are in the exterior package respectively the special case 11, takes place. This transport typically takes place using a vehicle. In FIG. 1B this transport is indicated in the upper portion of the drawing by means of an arrow T. In the vehicle the transport package, respectively the exterior package, respectively the special case 11 is preferably temporarily stored in a storage facility, such as for instance a shelf, and fixed, respectively secured by an interlocking mechanism.

The portable computer 20 is also transported to the client, in general together with the valuable articles 13. It can also arrive at the client in some other way.

When reaching the client or at the client a second client identifier K3 is recorded. This process is indicated at the top left of FIG. 1B. The second client identifier K3 is preferably recorded with the portable computer 20. It can be a bar code, as illustrated, which can be read or scanned by the portable computer 20. This second client identifier K3 can for instance be applied by the client in the area of an entrance door. It is also conceivable that the second client identifier K3 is made available by an employee of the client.

To make the overall system safer, the client could also enter an identifier, for instance a PIN. An embodiment is also conceivable where the escort guard has to confirm the entering of the client identifier K3 by entering an own identifier.

The second client identifier K3 is now processed together with the first client identifier K1 to determine whether the delivery has arrived at the right place or the right client. If two identical client identifiers K1 and K3 are used, then the analysis occurs in that the first client identifier K1 and the second client identifier K3 are compared with each other. In case of a match of the client identifier K1 and K3 the portable computer 20 assumes that the right client has been reached. Better suited, since more secure, however are key-based systems, where the two client identifiers K1 and K3 can only be analyzed, if a corresponding key, preferably a cryptographical key, is applied, or if, as described, in addition an identifier is to be entered by the client and/or escort guard.

If the analysis of the identifiers shows that one has arrived at the right client, the release of the employed transport package, in the present case the exterior package respectively the special case 11 occurs. This release can be done in different ways or manners. The interlocking-mechanism in the vehicle can for instance permit a release or unlocking of the exterior package respectively the special case 11 only if the analysis of the identifiers K1 and K3 was successful, and/or a disarming of the protective system of the exterior package respectively the special case 11 may occur only then, if the analysis of the client identifiers K1 and K3 was successful.

In FIG. 1B the release for opening the exterior package respectively the special case 11 is carried out as follows: after the portable computer 20 has analyzed the client identifiers K1 and K3 and came to the conclusion that the client where one is, is in fact the client to be supplied, the exterior package respectively the special case 11 can be disarmed via an interface 21 (IR or RF), as shown at the bottom left side of FIG. 1B. Right beside it is shown that the exterior package respectively the special case 11 can be opened now without the built-in protection mechanism of the protection system to be triggered, which means without neutralizing or devaluating the valuable articles 13. The interior package respectively the interior bag 10 can now be removed from the opened exterior package respectively the special case 11, as indicated by the arrow 22.

On the basis of FIG. 1B further variants of the new method and the new overall system are described. A transportation guard can have his own escort identifier K4. This escort identifier K4 can for instance be applied on a chip card 23 or stored in this chip card 23. But it can also be, as mentioned, an identifier (e.g. a PIN), which is manually entered by the transportation guard. The chip card may also comprise a photo of the transportation guard and/or can be equipped with biometric identifying features of the transportation guard.

When arriving at the client or at the client the transportation guard may read in the escort identifier K4 with the portable computer 20. In the embodiment, the disarming respectively releasing of the transport package can only occur when in addition to the successful analysis of the two client identifiers K1 and K3 also the correct escort identifier K4 is provided.

The use of such an escort identifier K4 makes the overall system safer since only authorized escort guards can carry out the transport and handle the delivery of the valuable articles to the client.

The exterior package can be an exterior cask like the mentioned special case or a container, designed as security case or security container. The valuable articles 13 can, as already described, first be packed into the interior package 10, for instance into so-called interior bags. Security bags, also sealing bags, with flaps 10.1 and gluing strips 10.2, which together form a safety catch, can be employed as interior bags, as schematically depicted in FIG. 1A. Other safety catches are also conceivable. The safety catch 10.1, 10.2 permits the security bag 10 to be closed after it has been filled. The safety catch 10.1, 10.2 and the security bag 10 are so designed that a not-permitted manipulation or the opening of the security bag 10 leaves behind visible traces at the security bag.

The interior package with a safety catch 10.1, 10.2 like the ones of security bags are one-way packages. The safety catch acts like a letter seal and can in now way be opened without destruction. Interior packages can be realized as reusable packages when using special anti-temper seals instead of security catches. Here the special anti-temper seal has to be removed for opening, but the interior package itself does not get destroyed.

The safety of the transport between the cash-center and the client can be supplemented by additional security measures in the cash-center. For that purpose a monitoring of the filling of the transport package, in particular the interior package 10, can take place. This is particularly suitable if the valuable articles 13 to be transported are money in the form of bank notes or coins. The bank notes or coins are usually counted in the cash-center by counting-machines. Modern counting machines are able to recognize bank notes and coins of different nominations and to determine the total value of bank notes and coins in one counting run. A counting machine now can be provided with an attachment and sealing mechanism for a sealing bag, that is an interior package. The sealing bag can for instance be fixed and filled in an attachment right underneath a dispensing opening of the counting machine. After the filling of the sealing bag it is closed, for instance welded up. The attachment and the means for closing the sealing bag are designed so that the sealing bag can only be removed after it was closed. Other security measures are also possible when filling the transport package, for instance the bank notes can be counted and bundled so that no bank note can be removed from the bundle. The filling of the transport package with the bundle or the bundles can be recorded with the help of a camera.

Preferably, the package identifier K2, with which the interior package 10 has be provided, cannot be separated from the interior package 10. This package identifier K2 can be an identification number in case of a one-way package which is unique and which was applied or attached during the production. To give the whole new method more flexibility and to thereby expand the possible field of application, the package identifier K2 can be provided respectively programmable by an authorized person. In order for such a programmable system to be secure preferably security measures are taken so that only authorized persons can make a change or can provide a package identifier K2. Preferably the package identifier K2 is also generated by the computer 30. The cash-center software, which is installed on the computer 30, can have a special module for this.

If the interior package is omitted and a transport package is used which is only formed by an exterior package, the package identifier K2 is assigned to the exterior package respectively to the special case 11. In this case the package identifier K2 can be attached, for instance glued onto, the exterior package respectively special case 11, or the security circuit of the exterior package respectively the special case 11 could store the package identifier K2. The security circuit of the special case 11 may for instance comprise an RF-ID tag which can be programmed with the package identifier K2 by the computer 30 or by the computer 20.

If an interior package 10 as well as an exterior package 11 is used, the package identifier K2 may only be assigned to the interior package 10, as described further above in connection with FIG. 1A. A package identifier could be assigned to the interior package 10 as well as the exterior package 11. In this case the interior package and the exterior package could either carry the same package identifier K2, or the interior package and the exterior package carry different package identifiers.

Identifiers are particularly suited in the context of the present invention which can be easily read into a computer. For this purpose in the present context a bar code, that is a line code, or an RF-ID tag is preferred. For increasing the security at least one identifier should be machine-readable only so that it cannot be recognized by human sensing organs.

Figure 2:
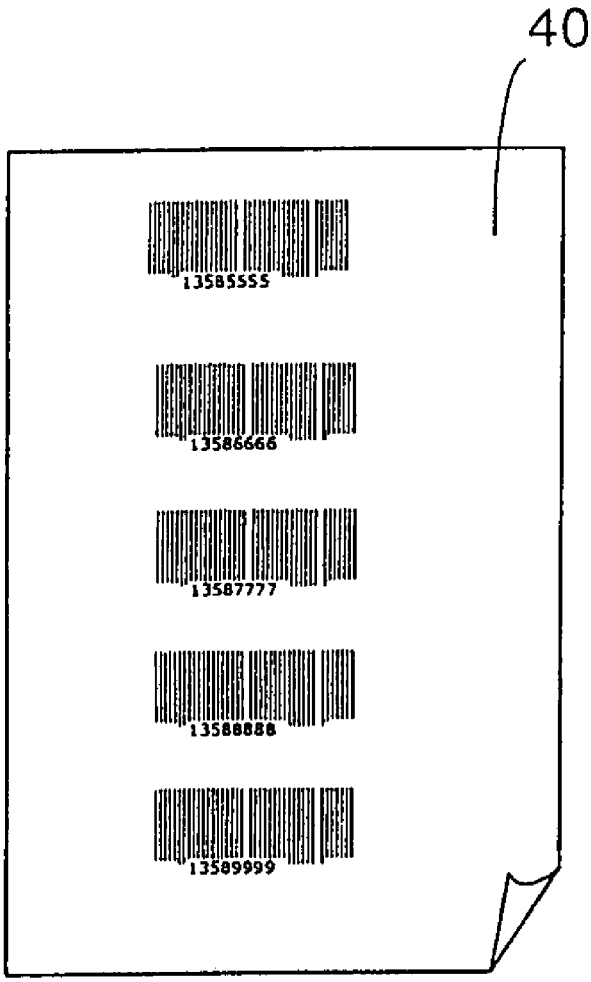

The client identifiers K1, K3 a generated as needed and the client identifier K3 is transmitted to the client. Alternatively, the client identifier K3 can be a client identifier K3 which is for instance taken from a check list. In this case the client gets a list 40 from time to time, as illustrated in FIG. 2, with a plurality of client identifiers K3. It is also possible to automatically generate the client identifiers K1 or K3 by means of a suitable algorithm in case of need. In this case no client identifier K3 is to be transmitted to the client but it is sufficient if the client can generate the client identifier K3 by means of an application software (client-software) installed or with a separate device, for instance a card reader in combination with a chip card (SmartCard).

In order to prevent tampering, modification or influencing of the client identifiers K1, K3, the client identifiers K1, K3 are preferably provided as bar code or in an RF-ID tag as identifier. In a simpler embodiment the client identifier is an alphanumeric sequence. It is also possible to use a combination of bar code with RF-ID tag, like the one offered for instance using the name GemWave™ RFID. It is also conceivable to use a machine readable identifier in combination with a PIN or the like, which can be entered by a person.

In some embodiments where the client identifier K3 is transmitted to the client, this transmission can occur via a network or a dedicated connection. The transmission can be encrypted. It is also conceivable to do the transmission for instance by SMS, E-Mail, facsimile or phone. The client could have a bar code printer on which the client identifier K3 can be printed or the client can have a computer with a transmitter to program an RF-ID tag.

The security measures are important since it can be ensured only by the analyzing of the first client identifier K1 and the second client identifier K3 that the correct client is being delivered to.

Depending on the embodiment it is important that third parties do not have access to the client identifiers K1 and/or K3. If however an overall system is employed, where the analysis of the two client identifiers K1 and K3 is attached to further conditions, like for instance the availability of a corresponding key or the provision of at least a further identifier, then it is less important to make the client identifiers K1 and K3 inaccessible to third parties. This is in particular the case if in addition to the successful analysis of the two client identifiers K1 and K3 the correct escort identifier K4 is to be present, as described further above.

By using suitable identifiers and by the employment of special hard and software a complete chain between the cash-center and the client can be developed. On the one hand the inventive method and the corresponding hard and software make it possible to protect the most diverse steps and on the other hand recording the individual steps is made possible. This recording can take place, in order to document and store the individual operational sequences. These procedures are recorded and documented in a preferred embodiment in the cash-center. For this purpose information from the portable computer 20 is transmitted to the computer 30, as soon as transport is completed.

It is also possible to realize a track and trace function like it is known from the logistics field. Thus one can for example always reconstruct where a transport package is.

In order to increase security during the transport of the valuable articles further, a series of additional measures can be implemented.

Preferably before transport to the client a time window (called total time) is given. This time window can be handed over to the interior cask (interior bag, money cassette or such a thing) or preferably into the exterior cask, for example into the special case 11, and/or to the portable computer 20. Numerous manipulations or wrong treatments can be eliminated by a suitable establishment of the time window, as is described on the basis of an example. Before the transport of valuable articles a route is specified for the transportation process. This is done via the cash-centers software on the computer 30. After packaging a desired quantity of the valuable articles 13 to be transported the exterior package 11 is armed, i.e. switched on. In addition a time window is given to it. Starting from this moment the exterior package 11 can be only disarmed and be brought into a condition, in which it can be opened without destruction of the valuable articles, if disarming is done within the time window. If the exterior package 11 does not arrive for example within the given time window at the client, then it can be no longer disarmed by the transportation escort and/or the client. In such a case the special case 11 must be newly initiated or programmed by an authorized person.

Alternatively or additionally a so-called pavement time can be provided. If the transportation package does not arrive within the pavement time at the vehicle, or from the vehicle to the client, then the neutralization of the valuable articles can be triggered or at least the disarming of the case by means of the portable computer 20 can be prevented.

Further one can give a buffer time. If the transportation package is once closed and armed, then it cannot be opened any more so long the buffer time has not yet lapse.

In combination with a special vehicle the overall system can be further developed, in order to offer additional security.

An exterior package can be brought into the vehicle after filling in the valuable articles and arming it and be fixed there respectively locked electromechanically in the vehicle. This locking device can preferably be done with the electromechanical interlocking system mentioned above, whereby the exterior package is removable from the vehicle only, if by the interlocking system a release or unblocking has taken place.

The locking device in the vehicle can be provided with a programmable time window, which does not have to be identical to the time window (total time) of the transportation package. The programmable time window can be adjusted with consideration of the transportation route in such a way that the exterior package can be unlocked from the vehicle and released only within a certain period.

The locking device in the vehicle can also be provided with a programmable route window. This programmable route window is coupled with the odometer of the vehicle or with a GPS system and can be adjusted with consideration of the transportation route in such a way that the exterior package can be unlocked and released only then, if the route put behind by the vehicle lies within the route window, or if the vehicle approaches the destination or arrives there.

Instead of or additionally to the programmable time window and/or route window the releasing and/or unlocking from the vehicle can be made dependent for example also on the fact that a client identifier is conveyed to the vehicle and/or the exterior package. This can for example be done with the portable computer 20.

In connection with the vehicle used for transport the security of the valuable articles can be increased further by the fact that in case of an accident and/or an impact effect on the transport vehicle and/or at high temperatures due to a fire the releasing and/or unblocking of the transportation package is made impossible.

A transport vehicle is particularly suitable that comprises a SMS module. This SMS module can send either in an emergency situation or with the occurrence of special events a SMS, which for example can release a reaction in the cash-center. An embodiment is particularly preferred, where the SMS modules sends signals to a center with a given clock pulse. If sending a signal is missing, or if other discrepancies arise, then a reaction can be triggered. A possible reaction is locking the portable computer 20 in order to prevent that it is manipulated to open the transportation package.

The overall system according to invention comprises hard and software components, as was described in connection with different embodiments. Depending upon arrangement of the overall system there are to two or more software components. One of the software components (cash-center software) is on a computer in the cash-center, or on a computer which is connected with the cash-center by a network. A further software component is in the portable computer 20. Possibly also the client has yet a further software component (Client software).

The security of the overall system can be further improved, if the transportation escort reads the client identifier K3 present at the client but also a personal escort identifier K4 when arriving at the client. For this purpose the transportation escort may carry a badge, a bar code, a RF-ID tag or a chipcard (verification card) with himself, as described further above. The escort identifier K4 can be newly issued before each transport, in order to lend to the overall system additional security.

In a particularly preferred embodiment a real time monitoring is built up, which supervises and examines each individual step. If discrepancies, like deviations from a given route or deviations from the schedule, are determined then suitable measures can be taken. With such an overall system with real time monitoring a central computer is used which collects and evaluates the information about the individual steps. For this purpose either the computer 30 in the cash-center or the portable computer 20 sends information to the central computer. This preferably happens if transport is prepared or begins. Then a computer at the client and/or the portable computer 20 can supply further information with the arrival at the client to the central computer. So step by step the procedure can be recorded and also examined. If discrepancies or other conspicuous issues are recognized, then the central computer can block the portable computer 20. Thus analyzing and releasing the delivery at the client can be prevented or stopped.

By the employment of a central computer, if necessary also a combination of several linked computers, an automatic tracking and tracking down of the valuable articles can be made possible. The central computer at any time knows on which section of the transportation chain the valuable articles are or can be found.

There are different communication channels, which are used in connection with the invention. In the following first some generally valid statements are made, which apply to all these communication channels, and afterwards specific characteristics of the individual communication channels will be described.

It is obvious that one can use standard components and standardized protocols for the communication channels. This leads to reduced system costs and to an increased compatibility of the individual components. In addition the handling and repairs under circumstances are less complex. These advantages however can, depending upon system, bring also some disadvantages with themselves. If one uses for example a RS232 link or IR link, then it is perhaps possible for third parties to affect or at least eavesdrop the communication with system external devices. In addition the communication can be disturbed possibly on purpose, in order to produce so a safety gap.

It is important that the overall system does not need continuing network or other communication connection. The individual components are substantially self-sufficient. Embodiments, which avail themselves of different communication channels, are particularly preferred. Thus the manipulation and eavesdropping possibilities for unauthorized third parties are strongly reduced.

Between the portable computer 20 and the transportation package (for example the special case 11) an IR or a RF link is preferably used. The connection between the computer 30 in the cash-center and the client is, as mentioned, preferably made by a network or a telephone, a fax, and/or portable radio connection. A GPRS (general pack radio service) or a UMTS connection to the portable computer 20 is particularly preferred.

The invention claimed is:

1. Method for the safe transport of valuable articles to a client comprising the following steps:

packing valuable articles to be transported in a transport package, the transport package comprising a security circuit and a security system adapted to devaluate the valuable articles in case of an unauthorized manipulation of the transport package;

arming the security system of the transport package into an armed state;

providing a first client identifier that identifies the client to whom the valuable articles are to be transported;

transporting the valuable articles in the transport package to the client; and transporting a portable computer with the valuable articles to said identified client, said portable computer being separate from but transported with the transport package transporting said valuable articles, and the portable computer performing the following steps:

at least one of (i) recording and (ii) capturing the first client identifier, and capturing a second client identifier at the client, and analyzing the first client identifier and the second client identifier, and based on said analyzing, establishing a communications connection with the security circuit of the transport package to bring it from the armed state into a not-armed state and to clear it if the analyzing of the client identifiers permits this.

2. The method according to claim 1, further comprising the following steps:

providing a computer, which provides the first client identifier;

capturing a package identifier of the transport package by a computer; and transmitting the first client identifier from the computer to the portable computer.

3. The method according to claim 2, further comprising the following steps:

compiling transport data by the computer; and recording the transport data by the portable computer.

4. The method according to claim 1, wherein a combination of an interior package, and an exterior package serves as the transport package.

5. The method according to claim 4, wherein after disarming of the transport package used, the interior package with the valuable articles is removed out of the exterior package and a package identifier is captured in at least one of (i) a client computer and (ii) the portable computer.

6. The method according to claim 2, wherein the second client identifier is transmitted by the computer to the client whereby the transmittal occurs daily or as needed.

7. The method according to claim 6, wherein the transmittal of the second client identifier occurs by at least one of (i) facsimile (ii) E-Mail (iii) SMS and (iv) telephone.

8. The method according to claim 1, wherein at least one of (i) the first client identifier and (ii) a package identifier is provided by reading it into the computer by a read unit, which is connectable to the computer, or at least one of (i) the first client identifier and (ii) a package identifier is provided by reading it into the portable computer, which comprises a respective read unit.

9. The method according to claim 3, wherein one of:

a) the transport data contain at least one of the following information:

the first client identifier, and the package identifier; and b) the transport data contain both the first client identifier, and the package identifier.

10. The method according to claim 1, wherein the transport package becomes armored or armors itself after it is filled with the valuable articles to be transported.

11. The method according to claim 1, wherein when filling, the security circuit of the transport package is programmed for the transport, whereby this programming is done with the aid of the portable computer.

12. The method according to claim 11, wherein during the programming, at least one of the following parameters are defined:

a pavement time, a total time, a buffer time, and package identifiers of interior package(s) used inside an exterior package.

13. The method according to claim 11, wherein the programming of the transport package is possible only if a cryptographic key is entered.

14. The method according to one of the preceding claims, wherein the transport package is brought to a vehicle and locked therein by an interlocking mechanism to a storage means.

15. The method according to claim 14, wherein the transport package can only be removed from the storage means if it is released from the interlocking mechanism by means of the portable computer, whereby this releasing is possible only if certain conditions are fulfilled.

16. The method according to claim 14, wherein the transport package is brought by the vehicle to the client and can be opened or disarmed only after releasing of the transport package has taken place.

17. Overall system for safe transport of valuable articles to a client, comprising the following components:

a transport package configured for being filled with the valuable articles, which is in an armed state during said transport, with a security circuit and a security system for the valuable articles, in order, in the armed state, to neutralize the valuable articles in case of an unauthorized manipulation of the transport package;

means for providing a first client identifier that identifies the client to whom the valuable articles are to be transported;

a portable computer which is separate from but transported with the transport package containing the valuable articles and which is adapted to:

at least one of (i) record and (ii) capture the first client identifier, and capture a second client identifier at the client, and analyze the first client identifier and the second client identifier, and based on said analyzing, establish a communications connection with the security circuit of the transport package to bring it from the armed state into a not-armed state and to clear it if the analyzing of the client identifiers permits this.

18. The overall system of claim 17, wherein the system comprises a computer to at least one of:

provide the first client identifier, capture a package identifier of the transport package, and transmit the first client identifier to the portable computer.

19. The overall system of claim 18, wherein the computer is designed to generate transport data and to transmit the data to the portable computer.

20. The method according to claim 1 wherein the first client identifier is different from the second client identifier.

21. The method according to claim 1, wherein the portable computer further performs the step of determining whether the transport package has arrived at the correct client.

22. The overall system of claim 18, wherein the portable computer is further adapted to determine whether the transport package has arrived at the correct client.

* * * * *